US010429773B2

(12) United States Patent
Sunohara et al.

(10) Patent No.: US 10,429,773 B2
(45) Date of Patent: Oct. 1, 2019

(54) FIXING DEVICE DETECTING ABNORMALITIES AT A TEMPERATURE LOWER THAN FIXING TEMPERATURE AND IMAGE FORMING APPARATUS

(71) Applicant: FUJI XEROX CO., LTD., Tokyo (JP)

(72) Inventors: Tsuyoshi Sunohara, Kanagawa (JP); Takahito Chiba, Kanagawa (JP)

(73) Assignee: FUJI XEROX CO., LTD., Minato-Ku, Tokyo (JP)

( * ) Notice: Subject to any disclaimer, the term of this patent is extended or adjusted under 35 U.S.C. 154(b) by 0 days.

(21) Appl. No.: 15/916,342

(22) Filed: Mar. 9, 2018

(65) Prior Publication Data

US 2019/0072884 A1 Mar. 7, 2019

(30) Foreign Application Priority Data

Sep. 6, 2017 (JP) ..... 2017-171180

(51) Int. Cl.

| | |
|---|---|
| ***G03G 15/20*** | (2006.01) |
| ***G03G 15/16*** | (2006.01) |
| ***G03G 15/00*** | (2006.01) |
| ***G03G 21/16*** | (2006.01) |

(52) U.S. Cl.

CPC ..... *G03G 15/2028* (2013.01); *G03G 15/1615* (2013.01); *G03G 15/205* (2013.01); *G03G 15/2017* (2013.01); *G03G 15/2025* (2013.01); *G03G 15/2039* (2013.01); *G03G 15/55* (2013.01); *G03G 15/553* (2013.01); *G03G 15/602* (2013.01); *G03G 15/657* (2013.01); *G03G 15/70* (2013.01); *G03G 21/1647* (2013.01); *G03G 21/1685* (2013.01); *G03G 2215/00413* (2013.01); *G03G 2221/1657* (2013.01)

(58) Field of Classification Search

CPC .... G03G 15/205; G03G 15/55; G03G 15/553; G03G 15/657; G03G 15/70; G03G 15/2025; G03G 15/1615; G03G 15/2039; G03G 15/602; G03G 21/1685; G03G 2215/00413

See application file for complete search history.

(56) References Cited

U.S. PATENT DOCUMENTS

2011/0097093 A1* 4/2011 Birumachi ..... G03G 15/2064 399/21

FOREIGN PATENT DOCUMENTS

| | | |
|---|---|---|
| JP | 2012-147049 A | 8/2012 |
| JP | 2013-025196 A | 2/2013 |

* cited by examiner

*Primary Examiner* — Joseph S Wong
(74) *Attorney, Agent, or Firm* — Sughrue Mion, PLLC

(57) ABSTRACT

A fixing device includes a fixing unit including a pressing device and a heating device and that fixes an image formed on a recording medium by nipping the recording medium with the pressing device and the heating device; a driving device that drives the fixing unit; a load detector that detects a load applied to the driving device; and an abnormality detector that detects abnormality in the fixing unit with reference to the load generated when the recording medium passes through the fixing unit.

10 Claims, 10 Drawing Sheets

FIXING DEVICE DETECTING ABNORMALITIES AT A TEMPERATURE LOWER THAN FIXING TEMPERATURE AND IMAGE FORMING APPARATUS

CROSS-REFERENCE TO RELATED APPLICATIONS

This application is based on and claims priority under 35 USC 119 from Japanese Patent Application No. 2017-171180 filed Sep. 6, 2017.

BACKGROUND

Technical Field

The present invention relates to a fixing device and an image forming apparatus.

SUMMARY

According to an aspect of the invention, there is provided a fixing device includes a fixing unit including a pressing device and a heating device and that fixes an image formed on a recording medium by nipping the recording medium with the pressing device and the heating device; a driving device that drives the fixing unit; a load detector that detects a load applied to the driving device; and an abnormality detector that detects abnormality in the fixing unit with reference to the load generated when the recording medium passes through the fixing unit.

BRIEF DESCRIPTION OF THE DRAWINGS

Exemplary embodiments of the present invention will be described in detail based on the following figures, wherein.

DETAILED DESCRIPTION

First Embodiment

Figure 1:
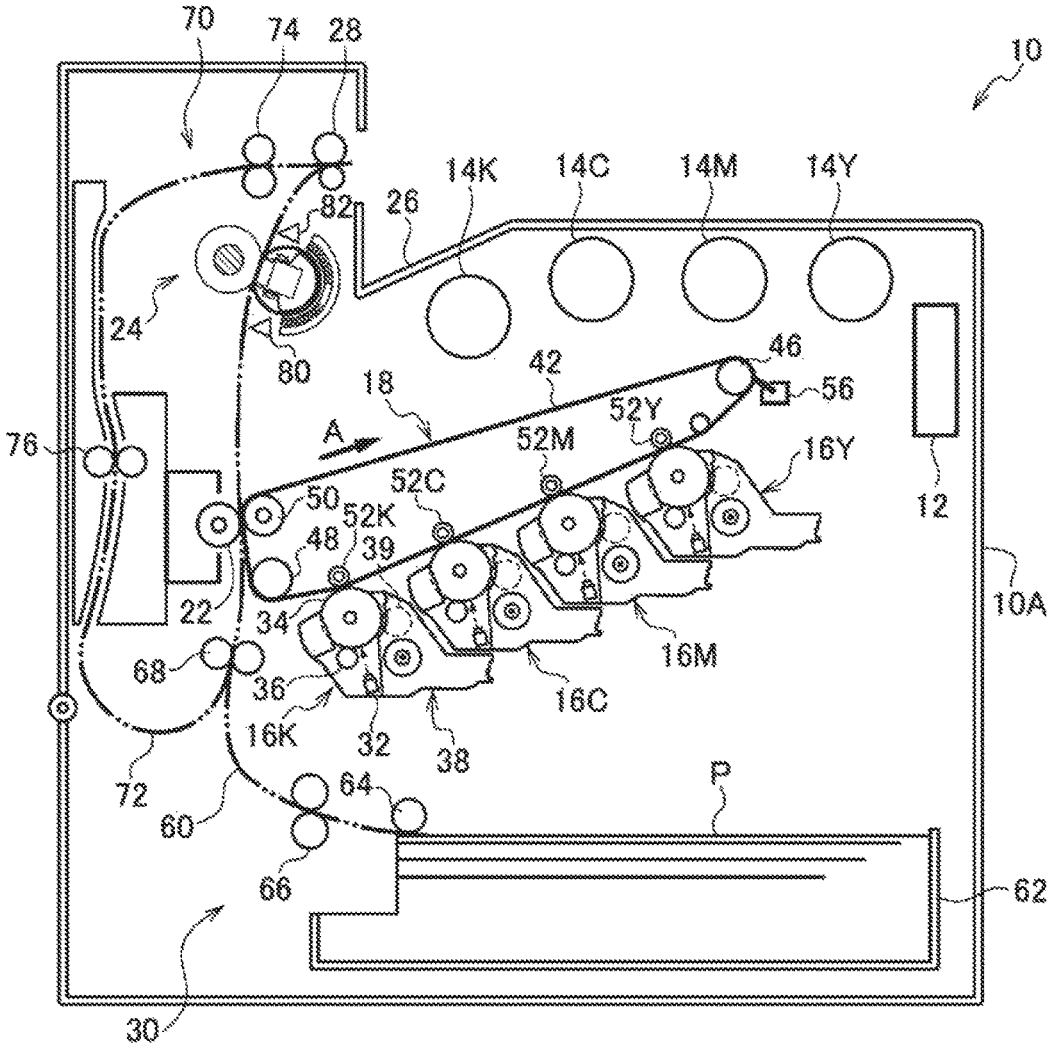
FIG. 1 is a schematic diagram illustrating a configuration of an image forming apparatus according to a first exemplary embodiment.
Figure 2:
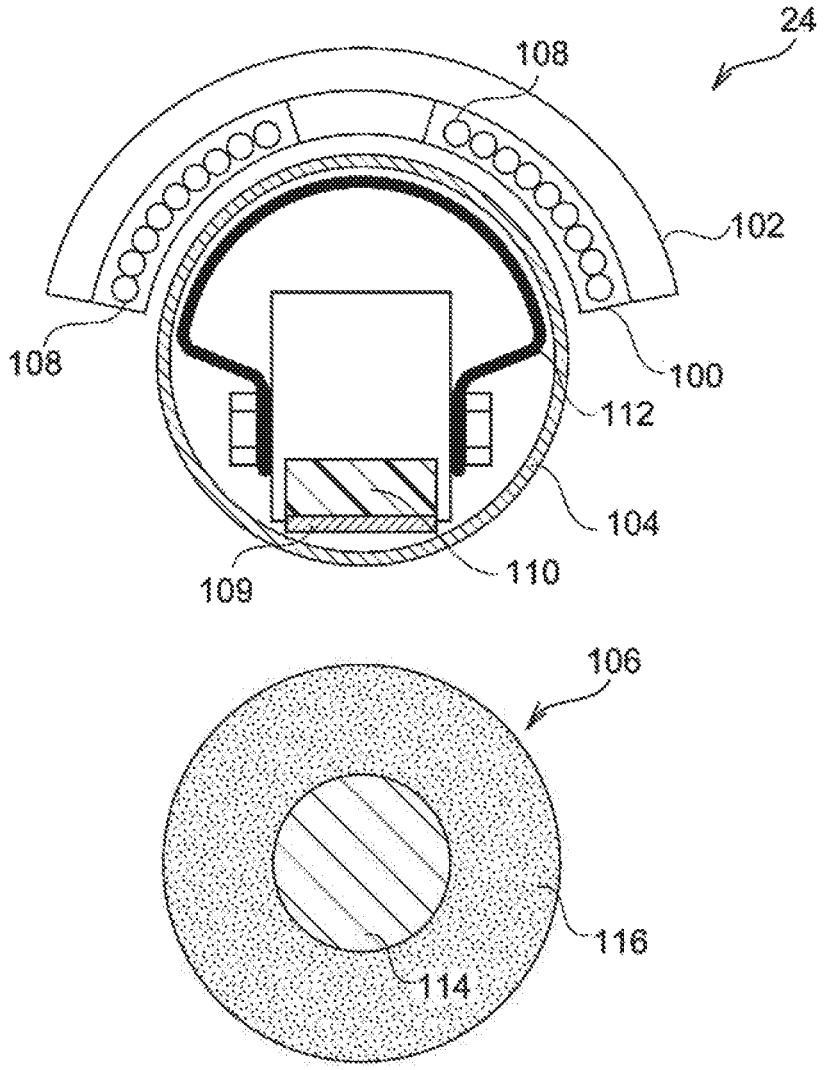
FIG. 2 is a schematic sectional diagram illustrating a configuration of a fixing device with a pressure roller thereof being at an away position.
Figure 3:
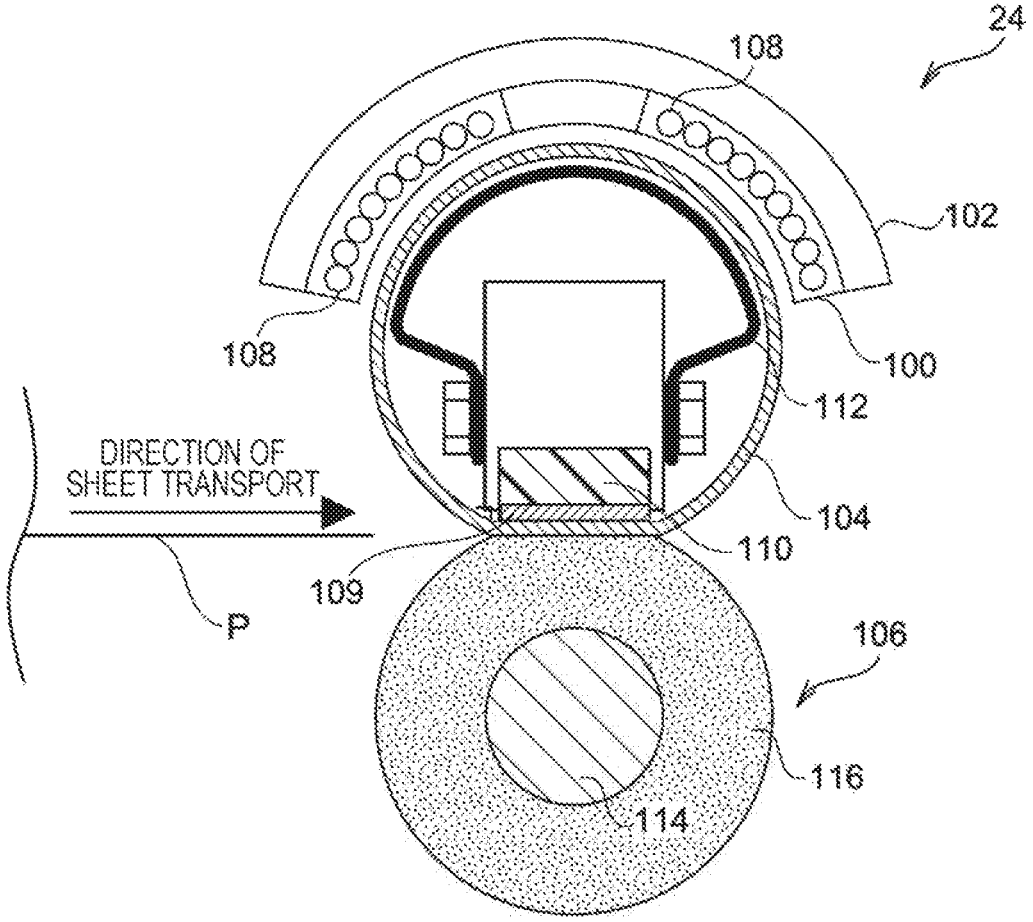
FIG. 3 is a schematic sectional diagram illustrating the configuration of the fixing device with the pressure roller thereof being at a pressing position.

Referring to FIGS. 1 to 3, a configuration of an image forming apparatus 10 according to a first exemplary embodiment will now be described. Hereinafter, colors of yellow, magenta, cyan, and black are denoted as Y, M, C, and K, respectively, and elements and toner images (images) that need to be distinguished from one another by their colors are denoted by reference numerals with corresponding suffixes representing the colors (Y, M, C, and K). If such elements and toner images do not need to be distinguished from one another by their colors, the elements and the toner images are generally denoted only by the respective reference numerals without the suffixes.

Overall Configuration

Referring to FIG. 1, the image forming apparatus 10 has an apparatus body 10A. The apparatus body 10A includes an image processing unit 12 that performs a process of converting image data inputted thereto into pieces of gradation data for the four respective colors of Y, M, C, and K.

The apparatus body 10A further includes image forming devices 16 that form toner images in the respective colors. The image forming devices 16 are provided in a central part of the apparatus body 10A and are arranged side by side at intervals in a direction tilted with respect to the horizontal direction. A first transfer unit 18 to which toner images formed by the respective image forming devices 16 are transferred one on top of another is provided above the image forming devices 16 in the vertical direction.

A second transfer roller 22 is provided on a side (the left side in FIG. 1) of the first transfer unit 18. The toner images transferred one on top of another to the first transfer unit 18 are further transferred to a sheet P transported along a transport path 60 by a feed-and-transport unit 30 to be described below. The sheet P is an exemplary recording medium.

A fixing device 24 is provided on the downstream side with respect to the second transfer roller 22 in a direction of transporting the sheet P (hereinafter referred to as "the direction of sheet transport"). The fixing device 24 fixes the toner images on the sheet P with heat and pressure.

A pair of discharge rollers 28 are provided on the downstream side with respect to the fixing device 24 in the direction of sheet transport. The sheet P having the fixed toner images is discharged by the pair of discharge rollers 28 onto a discharge portion 26 provided at the top of the apparatus body 10A of the image forming apparatus 10.

The feed-and-transport unit 30 that feeds and transports the sheet P extends from the lower side, in the vertical direction, and on a side of the image forming devices 16. Four toner cartridges 14 (14K, 14C, 14M, and 14Y) that contain respective toners are provided above the first transfer unit 18 in the vertical direction and are arranged side by side in the apparatus-width direction. The toners contained in the toner cartridges 14 are supplied to respective developing devices 38 to be described below. The toner cartridge 14 are each attachable to and detachable from the apparatus body 10A from the front side of the apparatus body 10A. The toner cartridge 14 each have a round columnar shape extending in the apparatus-depth direction and are connected to the respective developing devices 38 with respective supply tubes (not illustrated).

Image Forming Devices

As illustrated in FIG. 1, the image forming devices 16 provided for the respective colors all have the same configuration. Each of the image forming devices 16 includes a rotatable image carrier 34 having a round columnar shape, and a charging device 36 configured to charge the surface of the image carrier 34.

The image forming device 16 further includes a light-emitting-diode (LED) head 32 configured to emit an exposure beam to the charged surface of the image carrier 34. With the application of the exposure beam emitted from the LED head 32, an electrostatic latent image is formed on the image forming device 16. The image forming device 16 further includes the developing device 38 that develops and visualizes the electrostatic latent image with developer (in the first exemplary embodiment, negatively charged toner) into a toner image. The image forming device 16 further includes a cleaning blade (not illustrated) that cleans the surface of the image carrier 34.

The developing device 38 includes a developing roller 39 that faces the image carrier 34. In the developing device 38, the electrostatic latent image formed on the image carrier 34 is developed and visualized into a toner image with the developer supplied by the developing roller 39.

The charging device 36, the LED head 32, the developing roller 39, and the cleaning blade are provided in such a manner as to face the surface of the image carrier 34 and are arranged in that order from the upstream side toward the downstream side in the direction of rotation of the image carrier 34.

Transfer Unit (First Transfer Unit and Second Transfer Roller)

The first transfer unit 18 includes an endless intermediate transfer belt 42, and a driving roller 46 around which the intermediate transfer belt 42 runs and that is rotated by a motor (not illustrated) to cause the intermediate transfer belt 42 to rotate in the direction of arrow A. The first transfer unit 18 further includes a tension applying roller 48 around which the intermediate transfer belt 42 runs and that applies a tension to the intermediate transfer belt 42, and an assist roller 50 provided above the tension applying roller 48 in the vertical direction and that rotates by following the rotation of the intermediate transfer belt 42. The first transfer unit 18 further includes first transfer rollers 52 provided across the intermediate transfer belt 42 from the respective image carriers 34.

In the above configuration, the toner images formed in the different colors of Y, M, C, and K on the respective image carriers 34 of the image forming devices 16 are transferred by the respective first transfer rollers 52 to the intermediate transfer belt 42 in such a manner as to be superposed one on top of another.

In addition, a cleaning blade 56 that is in contact with the surface of the intermediate transfer belt 42 and thus cleans the surface of the intermediate transfer belt 42 is provided across the intermediate transfer belt 42 from the driving roller 46.

The second transfer roller 22 is provided across the intermediate transfer belt 42 from the assist roller 50. The second transfer roller 22 transfers the toner images on the intermediate transfer belt 42 to the sheet P transported thereto. The second transfer roller 22 is grounded. The assist roller 50 includes a counter electrode for the second transfer roller 22. When a second transfer voltage is applied to the assist roller 50, the toner images are transferred to the sheet P.

Feed-And-Transport Unit

The feed-and-transport unit 30 includes a sheet feeding member 62 provided in the apparatus body 10A and below the image forming devices 16 in the vertical direction. Plural sheets P are stacked on the sheet feeding member 62.

The feed-and-transport unit 30 further includes a feed roller 64 that feeds each of the sheets P stacked on the sheet feeding member 62 into the transport path 60, a pair of separating rollers 66 that separate one of some sheets P fed by the feed roller 64 from the others, and a pair of registration rollers 68 that adjust the timing of transporting the sheet P. These rollers are arranged in that order from the upstream side toward the downstream side in the direction of sheet transport.

In the above configuration, the sheet P fed by the sheet feeding member 62 is transported by the pair of registration rollers 68 that rotate with a predetermined timing to a point of contact (a second transfer position) between the intermediate transfer belt 42 and the second transfer roller 22.

Fixing Device

As illustrated in FIGS. 2 and 3, the fixing device 24 according to the first exemplary embodiment includes a coil unit 100, an outer magnetic member 102 containing soft ferrite or the like, a heating belt 104 as an exemplary heating device, and a pressure roller 106 as an exemplary pressing device. FIG. 2 illustrates an exemplary state where the pressure roller 106 is at an away position where the pressure roller 106 is spaced apart from the heating belt 104. FIG. 3 illustrates an exemplary state where the pressure roller 106 is at a pressing position where the pressure roller 106 is in contact with and pressing the heating belt 104.

The coil unit 100 includes thereinside plural exciting coils 108 that generate magnetic fields with the supply of electric power from a fixing power source (not illustrated). The heating belt 104 is an endless belt including a heating layer that generates heat by electromagnetic induction. The coil unit 100 further includes, on the inner side of the inner peripheral surface of the heating belt 104, a sliding sheet 109, a pressing pad 110 containing liquid-crystal polymer or the like, and an inner magnetic member 112 containing a thermosensitive magnetic alloy.

The pressure roller 106 includes a core metal 114 containing metal such as aluminum, and an elastic sponge layer 116 made of foamed silicon rubber or the like. The pressure roller 106 is movable between the away position (illustrated in FIG. 2) and the pressing position (illustrated in FIG. 3) by a latch mechanism 131 (see FIG. 4).

When the pressure roller 106 is at the away position, the object of driving of a motor 132 (see FIG. 4) as an exemplary driving device is switched to the heating belt 104 by a switching unit 133 (see FIG. 4), whereby the heating belt 104 is driven (rotated). On the other hand, when the pressure roller 106 is moved to the pressing position by the latch mechanism 131, the object of driving of the motor 132 is switched to the pressure roller 106 by the switching unit 133, whereby the pressure roller 106 is driven (rotated). Consequently, the heating belt 104 rotates by following the rotation of the pressure roller 106.

In the above configuration, the sheet P transported to the fixing device 24 is heated and pressed by the fixing device 24, whereby the toner images formed on one side (an image forming side) of the sheet P are fixed.

Furthermore, the feed-and-transport unit 30 includes a duplex transport device 70 used for forming toner images on the other side of the sheet P. To form toner images on the other side of the sheet P, the sheet P having the toner images fixed on one side by the fixing device 24 is not discharged onto the discharge portion 26 by the pair of discharge rollers 28.

The duplex transport device 70 includes a duplex transport path 72 along which the sheet P is turned over while being transported from the pair of discharge rollers 28 toward the pair of registration rollers 68, and pairs of transport rollers 74 and 76 that transport the sheet P along the duplex transport path 72.

Other Elements

The image forming apparatus 10 includes a sheet detecting sensor 80 provided on the upstream side and a sheet detecting sensor 82 provided on the downstream side with respect to the fixing device 24 in the direction of sheet transport along the transport path 60. The sheet detecting sensors 80 and 82 according to the first exemplary embodiment are each, for example, a reflection-type sensor including a pair of a light-emitting element and a light-receiving element. The sheet detecting sensors 80 and 82 each emit light from the light-emitting element to a corresponding one of detection positions on the transport path 60 where the sheet detecting sensor 80 or 82 is provided. The sheet detecting sensors 80 and 82 each output a signal (hereinafter referred to as "the detection signal") that is at a level corresponding to the amount of light received by the light-receiving element. Over the period in which the sheet P is transported through the detection position, the light emitted from the light-emitting element continues to be reflected by the sheet P. That is, the sheet detecting sensors 80 and 82 each output a detection signal whose signal level is different between a period over which the sheet P is transported through the detection position and a period over which the sheet P is not transported through the detection position.

While the first exemplary embodiment concerns a case where the sheet detecting sensors 80 and 82 are each a reflection-type sensor, the sheet detecting sensors 80 and 82 are not limited thereto and may each be any other sensor such as a transmission-type sensor.

Image Forming Process

First, pieces of gradation data for the respective colors are sequentially outputted from the image processing unit 12 to the respective LED heads 32. The exposure beams emitted from the LED heads 32 in accordance with the pieces of gradation data are applied to the surfaces of the respective image carriers 34 that have been charged by the respective charging devices 36. Thus, electrostatic latent images are formed on the surfaces of the respective image carriers 34. The electrostatic latent images formed on the image carriers 34 are developed and visualized by the respective developing devices 38 into toner images in the respective colors of Y, M, C, and K.

The toner images in the respective colors thus formed on the image carriers 34 are transferred to the rotating intermediate transfer belt 42 by the respective first transfer rollers 52 of the first transfer unit 18 in such a manner as to be superposed one on top of another.

The toner images transferred to the intermediate transfer belt 42 are second-transferred at the second transfer position by the second transfer roller 22 to the sheet P fed from the sheet feeding member 62 and transported by the feed roller 64, the pair of separating rollers 66, and the pair of registration rollers 68 along the transport path 60.

The sheet P having the toner images transferred thereto is transported to the fixing device 24, and the toner images on the sheet P are fixed by the fixing device 24. The sheet P having the fixed toner images is discharged onto the discharge portion 26 by the pair of discharge rollers 28.

If images are to be formed on both sides of the sheet P, the sheet P having toner images fixed on one side (the front side) thereof by the fixing device 24 is not discharged onto the discharge portion 26 by the pair of discharge rollers 28. Instead, the pair of discharge rollers 28 are rotated backward, whereby the direction of sheet transport is switched. Then, the sheet P is transported by the pairs of transport rollers 74 and 76 along the duplex transport path 72.

The sheet P transported along the duplex transport path 72 is turned over and is transported to the pair of registration rollers 68 again. Then, after another set of toner images are transferred to the other side (the back side) of the sheet P and are fixed, the sheet P is discharged onto the discharge portion 26 by the pair of discharge rollers 28.

Figure 4:
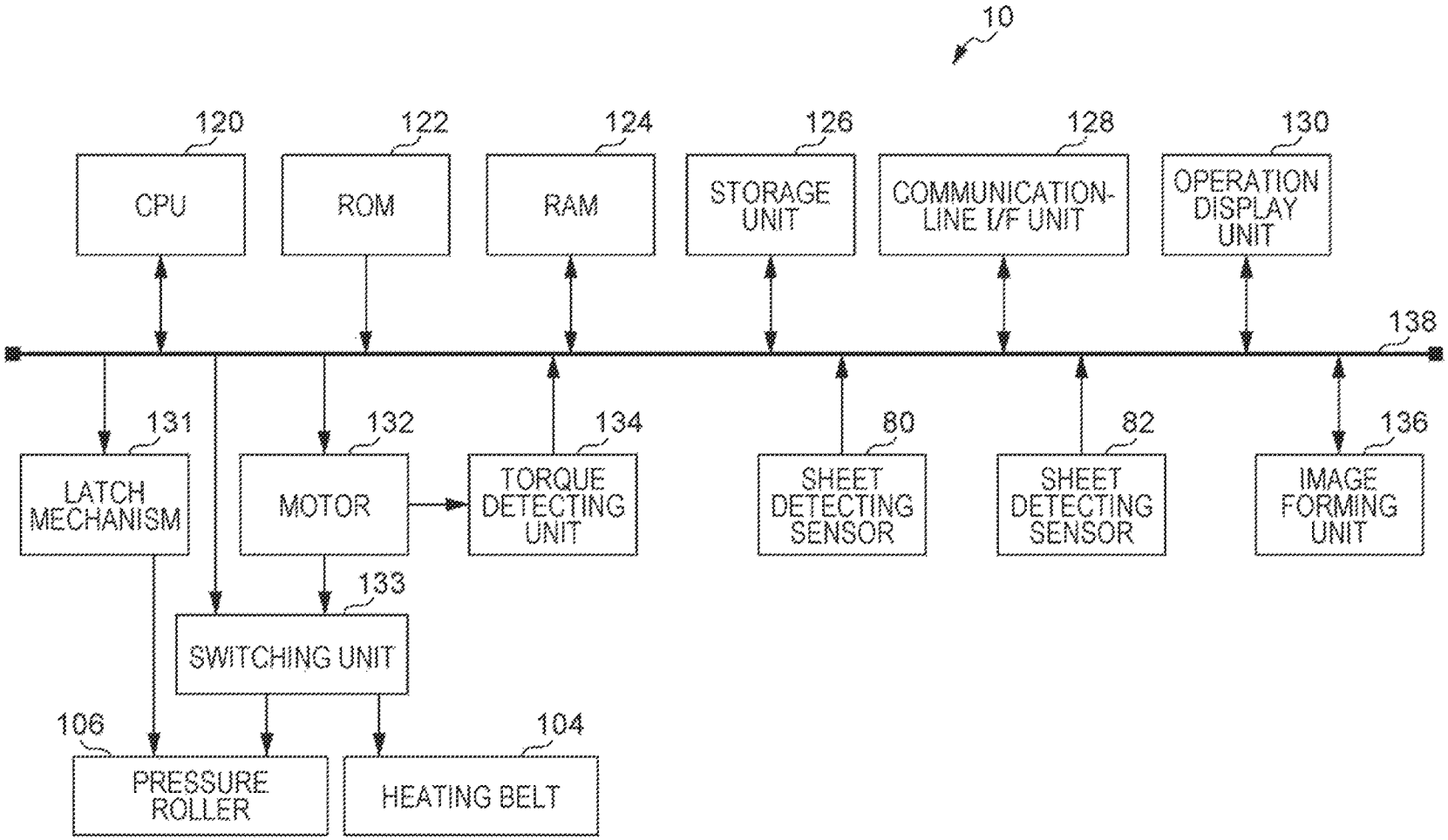
FIG. 4 is a block diagram illustrating relevant elements included in an electrical system of the image forming apparatus according to the first exemplary embodiment.

Referring now to FIG. 4, relevant elements included in an electrical system of the image forming apparatus 10 according to the first exemplary embodiment will be described.

As illustrated in FIG. 4, the image forming apparatus 10 according to the first exemplary embodiment includes a central processing unit (CPU) 120 that controls the overall operation of the image forming apparatus 10, and a read-only memory (ROM) 122 that stores programs and parameters in advance. The image forming apparatus 10 further includes a random-access memory (RAM) 124 used as a work area or the like for the CPU 120 to execute the programs, and a nonvolatile storage unit 126 such as a flash memory. The CPU 120 is an exemplary abnormality detector.

The image forming apparatus 10 further includes a communication-line interface (I/F) unit 128 that transmits and receives communication data to and from an external apparatus, and an operation display unit 130 that accepts a command made on the image forming apparatus 10 by the user and displays pieces of information on the state of operation of the image forming apparatus 10 to the user. The operation display unit 130 includes, for example, a display having a display surface with a touch panel on which a display button for executing and realizing the accepted command and various pieces of information are displayed, and hardware keys such as a numerical key pad and a start button.

The image forming apparatus 10 further includes a torque detecting unit 134 as an exemplary load detector that detects the load (torque) applied to the motor 132 that drives the heating belt 104 or the pressure roller 106. The torque detecting unit 134 according to the first exemplary embodiment is connected to the motor 132 and detects the torque applied to the motor 132 as a value of the electric current flowing through the motor 132.

The configuration of the torque detecting unit 134 according to the first exemplary embodiment is not specifically limited, as long as the torque detecting unit 134 is capable of detecting the torque applied to the motor 132. For example, the torque detecting unit 134 may be a device that detects the electric current by measuring the voltage between shunt resistors. As another example, the torque detecting unit 134 may be a device that detects the electric current by providing resistors on a path along which the electric current flows through the motor 132 and measuring the voltage between the resistors. As yet another example, the torque detecting unit 134 may be a device that detects the electric current by providing a current sensor including a Hole element on a path along which the electric current flows through the motor 132. As yet another example, the torque detecting unit 134 may be a device that converts the detected electric current into a voltage and outputs the converted value. As yet another example, the torque detecting unit 134 may be a torque detecting device that detects the torque applied to the motor 132.

The image forming apparatus 10 further includes an image forming unit 136 including elements that execute various processing operations regarding the image formation on the sheet P that are performed by the image forming devices 16, the first transfer unit 18, and so forth described above. The CPU 120, the ROM 122, the RAM 124, the storage unit 126, the communication-line I/F unit 128, the operation display unit 130, the latch mechanism 131, the motor 132, the switching unit 133, the torque detecting unit 134, the image forming unit 136, and the sheet detecting sensors 80 and 82 are connected to one another with a bus 138 including an address bus, a data bus, a control bus, and so forth.

In the above image forming apparatus 10 according to the first exemplary embodiment, the CPU 120 accesses the ROM 122, the RAM 124, and the storage unit 126 and transmits and receives communication data to and from the external apparatus via the communication-line I/F unit 128. Furthermore, the CPU 120 acquires pieces of information on various commands through the operation display unit 130 and causes the operation display unit 130 to display various pieces of information. Furthermore, the CPU 120 controls the motor 132, acquires the current value outputted from the torque detecting unit 134, and controls the image forming unit 136.

Furthermore, the CPU 120 of the image forming apparatus 10 acquires the detection signals outputted from the respective sheet detecting sensors 80 and 82. Therefore, in the image forming apparatus 10, whether or not the sheet P has passed each of the detection positions for the sheet detecting sensors 80 and 82 is detected with reference to the level of a corresponding one of the detection signals acquired by the CPU 120.

If any abnormality occurs in the fixing device 24 with, for example, aging or an instant load generated with the latching operation performed by the latch mechanism 131, the pressing force is reduced at the position of the abnormality. In such a case, defective fixing may occur. Note that the term "abnormality in the fixing device 24" refers to abnormality such as the breakage of the pressure roller 106 but is not limited thereto. For example, abnormality in the fixing device 24 also refers to abnormality in any other element such as the breakage of the heating belt 104.

To address such abnormality, the image forming apparatus 10 according to the first exemplary embodiment includes an abnormality detecting function that detects the occurrence of abnormality in the pressure roller 106 of the fixing device 24.

Figure 5:
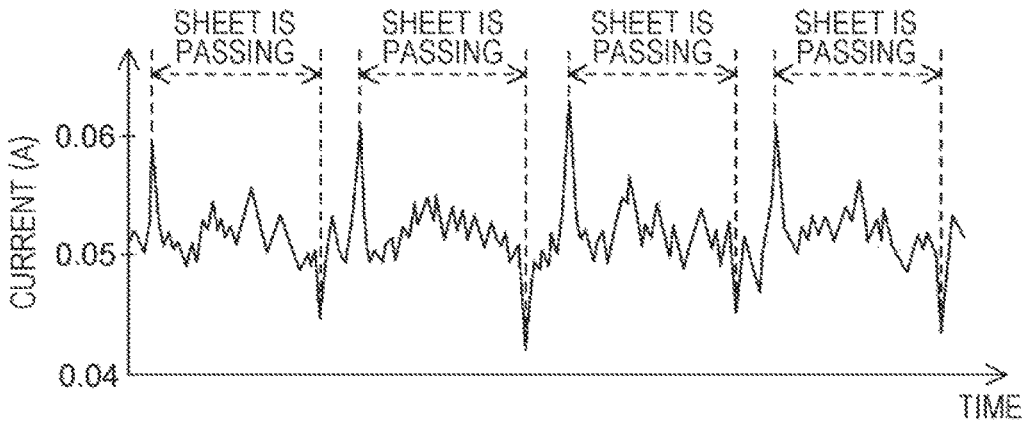
FIG. 5 is a graph illustrating an exemplary time-series data representing a normal state detected by a torque detecting unit.
Figure 6:
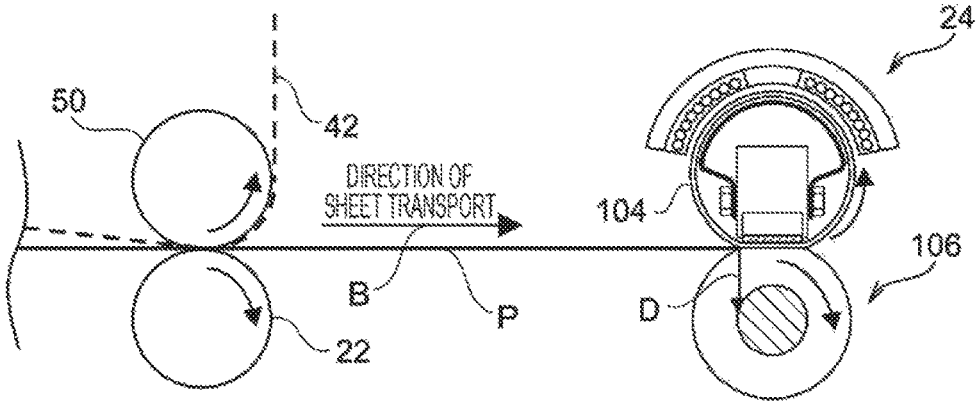
FIG. 6 is a schematic diagram provided for describing a timing with which a sheet enters the fixing device.
Figure 7:
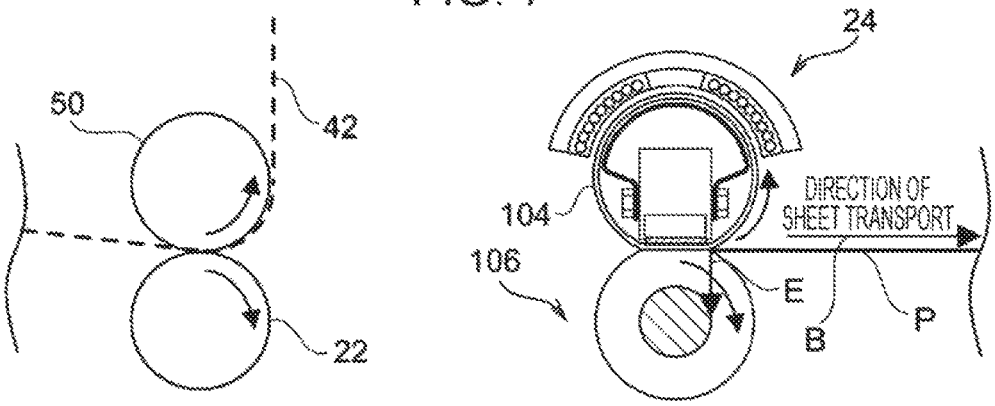
FIG. 7 is a schematic diagram provided for describing a timing with which a sheet exits the fixing device.

Referring now to FIGS. 5 to 7, the abnormality detecting function according to the first exemplary embodiment will be described in detail. FIG. 5 illustrates time-series data representing the current value outputted from the torque detecting unit 134 while four sheets P are transported normally one by one by the fixing device 24 that has no abnormality and the image on each of the sheets P is fixed by the fixing device 24. FIGS. 6 and 7 are diagrams for describing the time-series data representing the current value that is illustrated in FIG. 5 and illustrate the sheet P that is passing through respective positions. To avoid confusion, the intermediate transfer belt 42 illustrated in FIGS. 6 and 7 is represented by a broken line.

As illustrated in FIG. 5, the current value outputted from the torque detecting unit 134 becomes highest forming an upward peak when the leading end of the sheet P enters the fixing device 24, and becomes lowest forming a downward peak when the trailing end of the sheet P exits the fixing device 24.

Referring now to FIGS. 6 and 7, the principles of the time-series change in the current value graphed in FIG. 5 will be described. When the leading end of the sheet P enters the nip between the heating belt 104 and the pressure roller 106 of the fixing device 24 with the pressure roller 106 being at the pressing position as illustrated in FIG. 6 (a latch-on state), a force acting in a direction opposite to the direction of rotation of the pressure roller 106 (a force acting in the direction of arrow D illustrated in FIG. 6) is applied to the pressure roller 106, which increases the torque applied to the motor 132. Hence, the current value outputted from the torque detecting unit 134 also increases, whereby an upward peak is formed. Subsequently, the force in the opposite direction that is generated at the entry of the sheet P into the fixing device 24 is removed as the sheet P advances through the fixing device 24. Therefore, the current value is reduced.

When the trailing end of the sheet P exits the nip as illustrated in FIG. 7, a force acting in a direction conforming to the direction of rotation of the pressure roller 106 (a force acting in the direction of arrow E illustrated in FIG. 7) is applied to the pressure roller 106, which reduces the torque applied to the motor 132. Hence, the current value outputted from the torque detecting unit 134 is also reduced. Accordingly, a downward peak is formed.

After repeated use of the fixing device 24, the fixing device 24 may cause abnormality such as the breakage of the elastic sponge layer 116 of the pressure roller 106 with aging, and the pressing force may be reduced at the position of the abnormality. Therefore, if the fixing device 24 has any abnormality, the value of the current flowing through the motor 132 that is detected as the torque by the torque detecting unit 134 tends to become lower than in a case where the fixing device 24 has no abnormality.

To address such an incident, the abnormality detecting function according to the first exemplary embodiment detects abnormality in the fixing device 24 with reference to the value of the current that flows through the motor 132 when the sheet P passes through the fixing device 24.

Figure 8:
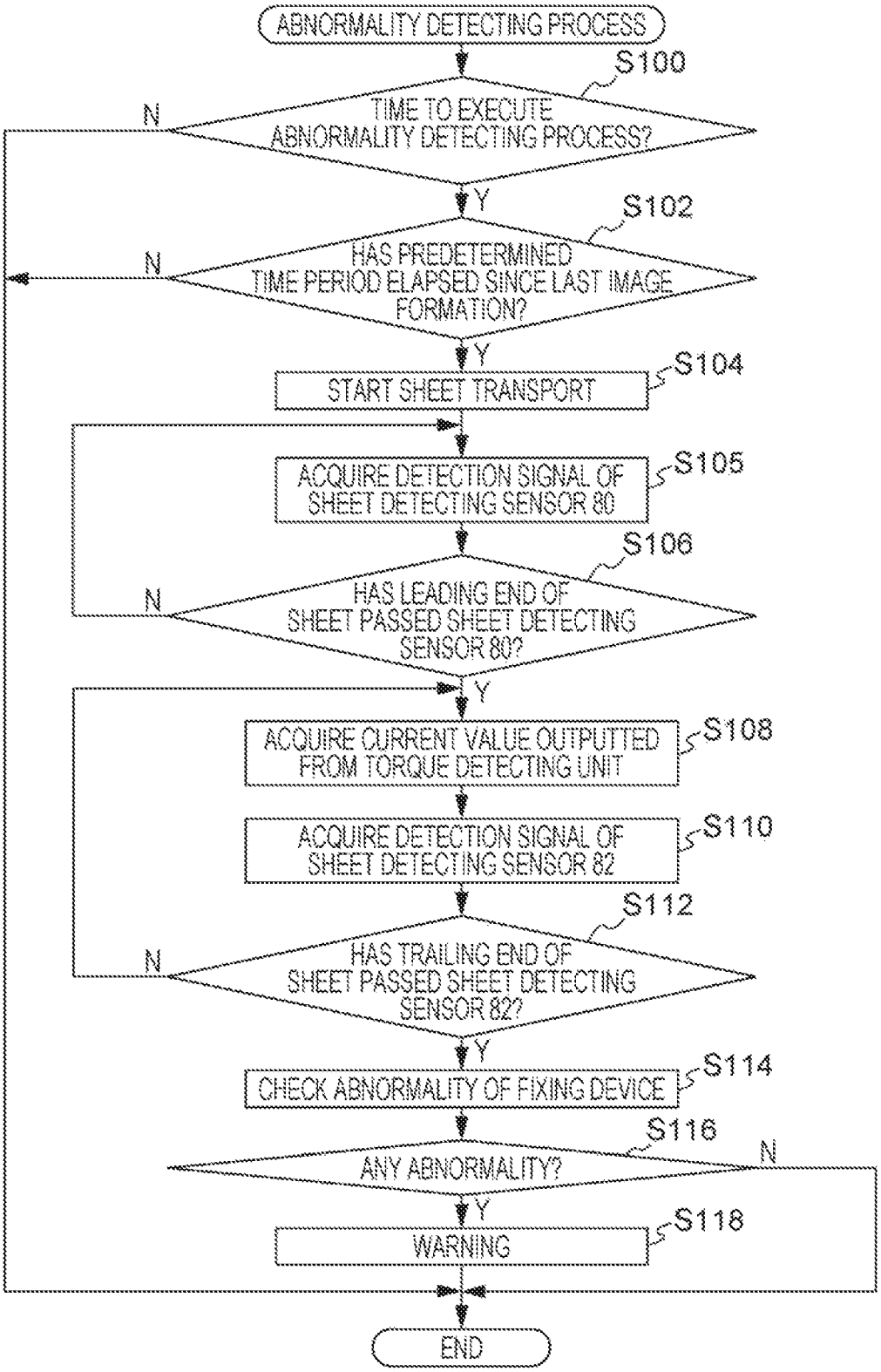
FIG. 8 is a flow chart illustrating a process of executing an abnormality detecting program according to the first exemplary embodiment.

Referring now to FIG. 8, an operation of the image forming apparatus 10 according to the first exemplary embodiment that is performed when the abnormality detecting function is executed will be described. FIG. 8 is a flow chart illustrating a process of executing an abnormality detecting program that is initiated by the CPU 120. The process of executing the abnormality detecting program illustrated in FIG. 8 is repeated as long as the image forming apparatus 10 is powered. The abnormality detecting program is preinstalled in the ROM 122. Herein, for simplicity in description, description of a process of executing a program for forming an image on the sheet P in the image forming process described above is omitted.

In step S100, whether or not it is time to execute the abnormality detecting process is checked. The time to execute the abnormality detecting process may be, but is not limited to, the time when the number of sheets P that have undergone the image forming process since the last execution of the abnormality detecting process has reached a predetermined value, or a predetermined time of the day.

For example, the number of sheets P is set to a value at which any abnormality in the fixing device 24 with aging or the like is likely to be detected. Specifically, the value may be, but is not limited to, several thousands.

If the determination in step S100 is positive, the process proceeds to step S102. If the determination in step S100 is negative, the process ends.

In step S102, whether or not a predetermined period of time has elapsed since the last execution of the image forming process on the sheet P is checked. The predetermined period of time is set to a period over which the temperature of the fixing device 24 becomes lower than a fixing temperature, which is a temperature set for the fixation of the image formed on the sheet P, after the last execution of the fixing process by the fixing device 24. The lower the temperature of the fixing device 24, the greater the change in the current value outputted from the torque detecting unit 134 when the fixing device 24 has abnormality. Therefore, the abnormality in the fixing device 24 is easy to detect. The temperature lower than the fixing temperature may be set to a standby temperature at which the fixing device 24 waits for the acceptance of another image forming command after one round of the image forming process is finished, or another temperature that is different from the standby temperature. In such a standby state, the temperature of the fixing device 24 is maintained prior to another round of the image forming process so as to be ready for the immediate execution of the next image forming command.

In the following description, a state where the temperature of the fixing device 24 is lower than the fixing temperature for the fixation of the image on the sheet P is referred to as the low-temperature state. The low-temperature state may be a state where the temperature of the fixing device 24 is lower than the fixing temperature for the fixation of the image on the sheet P and the difference from the fixing temperature is greater than or equal to a predetermined threshold. On the other hand, a state where the temperature of the fixing device 24 is higher than or equal to the fixing temperature for the fixation of the image on the sheet P is referred to as the high-temperature state. The fixing temperature is preset in accordance with, for example, the thickness of the sheet P.

If the determination in step S102 is positive, the process proceeds to step S104. If the determination in step S102 is negative, the process ends.

In step S104, the CPU 120 starts the transport of the sheet P. If any abnormality in the fixing device 24 is detected with reference to the load generated when the sheet P passes through the fixing device 24 in this process, the image forming unit 136 does not execute the image forming command.

In step S105, a detection signal outputted from the sheet detecting sensor 80 is acquired.

In step S106, on the basis of the detection signal acquired in step S105, the CPU 120 checks whether or not the leading end of the sheet P has passed the detection position for the sheet detecting sensor 80 on the transport path 60. If the determination by the CPU 120 in the step S106 is negative, the process returns to step S105. If the determination by the CPU 120 in step S106 is positive, the process proceeds to step S108.

If the sheet detecting sensor 80 is not provided, the CPU 120 may determine that the leading end of the sheet P has passed the detection position for the sheet detecting sensor 80 on the transport path 60 if, for example, the period of time elapsed from the start of transport of the sheet P from the sheet feeding member 62 has reached a value greater than or equal to a predetermined threshold. The threshold in that case may be determined arbitrarily from the distance along the transport path 60 between the sheet feeding member 62 and the fixing device 24 and the speed of transport of the sheet P.

In step S108, the CPU 120 acquires the current value outputted from the torque detecting unit 134.

In step S110, the CPU 120 acquires the detection signal outputted from the sheet detecting sensor 82.

In step S112, the CPU 120 checks whether or not the trailing end of the sheet P has passed the detection position for the sheet detecting sensor 82 on the transport path 60 on the basis of the detection signal acquired in step S110. If the determination by the CPU 120 in step S112 is negative, the process returns to step S108. If the determination by the CPU 120 in step S112 is positive, the process proceeds to step S114.

If the sheet detecting sensor 82 is not provided, the CPU 120 may determine that the trailing end of the sheet P has passed the detection position for the sheet detecting sensor 82 on the transport path 60 if, for example, the period of time elapsed from the start of transport of the sheet P from the sheet feeding member 62 has reached a value greater than or equal to a predetermined threshold. The threshold in that case may be determined arbitrarily from the distance along the transport path 60 between the sheet feeding member 62 and the fixing device 24 and the speed of transport of the sheet P. Alternatively, it may be determined that the trailing end of the sheet P has passed the detection position for the sheet detecting sensor 82 on the transport path 60 if a downward peak value is detected from the current value represented by the detection signal acquired in step S108.

Figure 9:
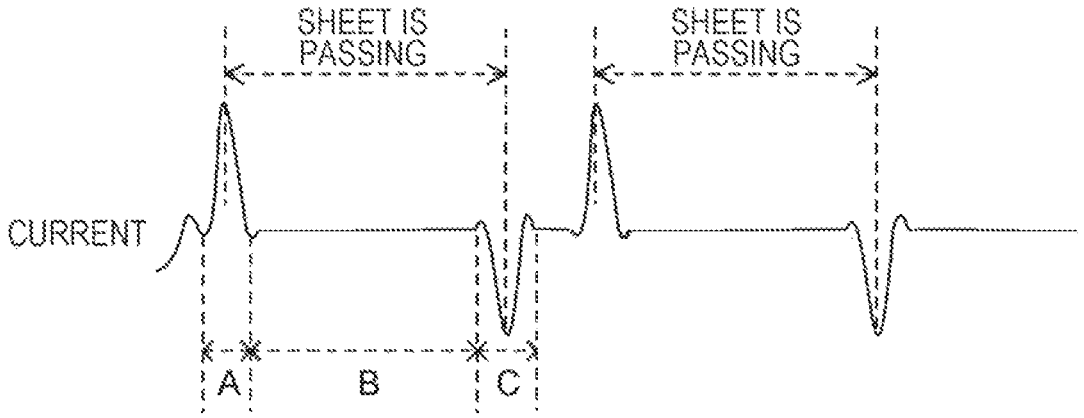
FIG. 9 is a graph illustrating an exemplary waveform of the electric current flowing through a motor.

The current value acquired in step S108 is the current value acquired during a period from when the leading end of the sheet P enters the fixing device 24 after passing the sheet detecting sensor 80 until when the trailing end of the sheet P passes the sheet detecting sensor 82. Therefore, the current value acquired is regarded as the current value observed over a period including an upward peak value and a downward peak value. That is, the current value acquired in step S108 is a current value observed in one of an entering period A over which the sheet P enters the fixing device 24, a passing period B over which the sheet P passes through the fixing device 24, and an exiting period C over which the sheet P exits the fixing device 24, which are illustrated in FIG. 9.

Hence, in step S114, the CPU 120 detects whether or not the fixing device 24 has any abnormality with reference to the current value acquired in step S108 during at least part of the passing period B excluding the entering period A and the exiting period C.

For example, the CPU 120 detects whether or not the fixing device 24 has any abnormality with reference to a representative one of current values acquired during at least part of the passing period B. The representative value may be, but is not limited to, one of the average value, the mean value, the maximum value, and the minimum value. Note that whether or not the fixing device 24 has any abnormality may be checked with reference to the current value acquired during the whole passing period B or the current value acquired during part of the passing period B.

Specifically, the CPU 120 detects whether or not the fixing device 24 has any abnormality by comparing the initial value of the representative current value acquired during at least part of the passing period B (hereinafter simply referred to as the initial value) and the current value outputted from the torque detecting unit 134 and acquired in step S105 (hereinafter referred to as the detected current value).

Figure 10:
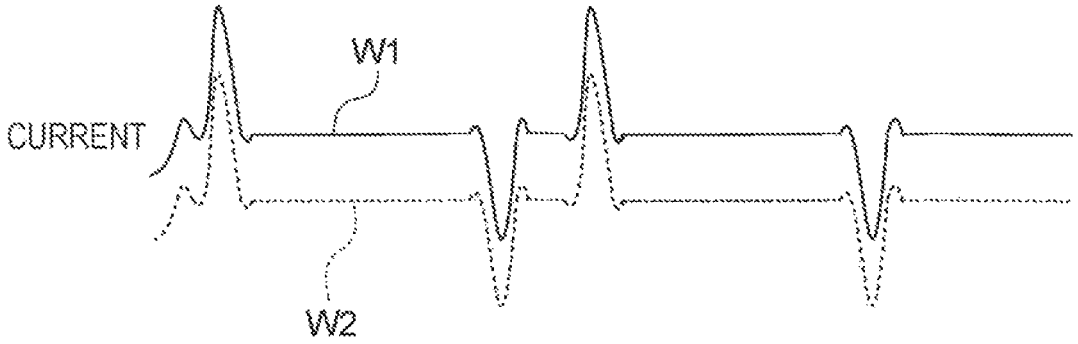
FIG. 10 is a graph illustrating exemplary waveforms of the electric current flowing through the motor when the fixing device is in the initial state and when the fixing device has abnormality, respectively.

For example, if the detected current value is measured by transporting the sheet P in an initial state where the fixing device 24 has not substantially been used yet, a waveform W1 illustrated in FIG. 10 would be observed. If any abnormality such as the breakage of the pressure roller 106 has occurred, the detected current value becomes generally low, forming a waveform W2 illustrated in FIG. 10.

Hence, if the difference between the initial value and the detected current value is greater than or equal to a predetermined threshold, it is determined that the fixing device 24 has abnormality. In this case, the initial value may be a representative one of detected current values that are measured by transporting the sheet P at the time of shipping of the image forming apparatus 10, or may be a representative one of detected current values that are measured by transporting the sheet P at the time of initial installation of the image forming apparatus 10 or at the time of replacement of the fixing device 24 with a new one. In either case, the initial value is stored in the storage unit 126.

The threshold is set arbitrarily on the basis of, for example, the result of an experiment performed in advance for finding the relationship between the difference between the initial value and the detected current value and the occurrence of abnormality in the fixing device 24. That is, the threshold is set such that if the difference between the initial value and the detected current value is greater than or equal to that threshold, it is regarded that the fixing device 24 does or may cause abnormality.

In step S116, the CPU 120 checks whether or not any abnormality in the fixing device 24 has been detected. If the determination in step S116 is positive, the process proceeds to step S118. If the determination in step S116 is negative, the process ends.

In step S118, the CPU 120 gives the user a warning by, for example, causing the operation display unit 130 to display a message indicating that the occurrence or the possible occurrence of abnormality in the fixing device 24 has been detected. If an image forming process is in progress in the image forming apparatus 10, the image forming process may be aborted, in addition to the warning.

As described above, according to the first exemplary embodiment, whether or not the fixing device 24 has any abnormality is detected with reference to a representative one of current values acquired during at least part of the passing period B.

Alternatively, whether or not the fixing device 24 has any abnormality may be detected with reference to a representative one of current values acquired during the entering period A over which the sheet P enters the fixing device 24 or during the passing period B over which the sheet P exits the fixing device 24.

The first exemplary embodiment concerns a case where the abnormality detecting process is executed in step S102 if a predetermined period of time has elapsed since the last execution of the image forming process on the sheet P. Alternatively, step S102 may be omitted. That is, the abnormality detecting process may be executed before the predetermined period of time elapses. In that case, the fixing device 24 is in the high-temperature state, such as a state immediately after the execution of an image forming process. Even if the fixing device 24 is in the high-temperature state, the detected current value acquired when the fixing device 24 has abnormality is lower than the initial value acquired in the high-temperature state. Note that as the temperature of the fixing device 24 increases, the difference between the detected current value and the initial value in the state where the fixing device 24 has abnormality becomes smaller.

Hence, in step S114 in which whether or not the difference between the initial value and the detected current value is greater than or equal to the threshold is checked, the initial value and the threshold may be adjusted in accordance with the temperature of the fixing device 24. Specifically, as the period of time elapsed since the last execution of the image forming process increases, the temperature of the fixing device 24 is lowered. Therefore, the initial value and the threshold may be made smaller with the increase in the period of time elapsed, and step S114 may be performed on the basis of the initial value and the threshold thus adjusted.

Alternatively, the abnormality detecting process illustrated in FIG. 8 may be executed while the image forming process is in progress. In that case, since the image forming process is in progress, the fixing device 24 is in the high-temperature state. Furthermore, since the sheet P is being transported, step S102 and step S104 are omitted.

Second Exemplary Embodiment

A second exemplary embodiment of the present invention will now be described. Elements that are the same as those described in the first exemplary embodiment are denoted by corresponding ones of the reference numerals used in the first exemplary embodiment, and detailed description of such elements is omitted.

Figure 11:
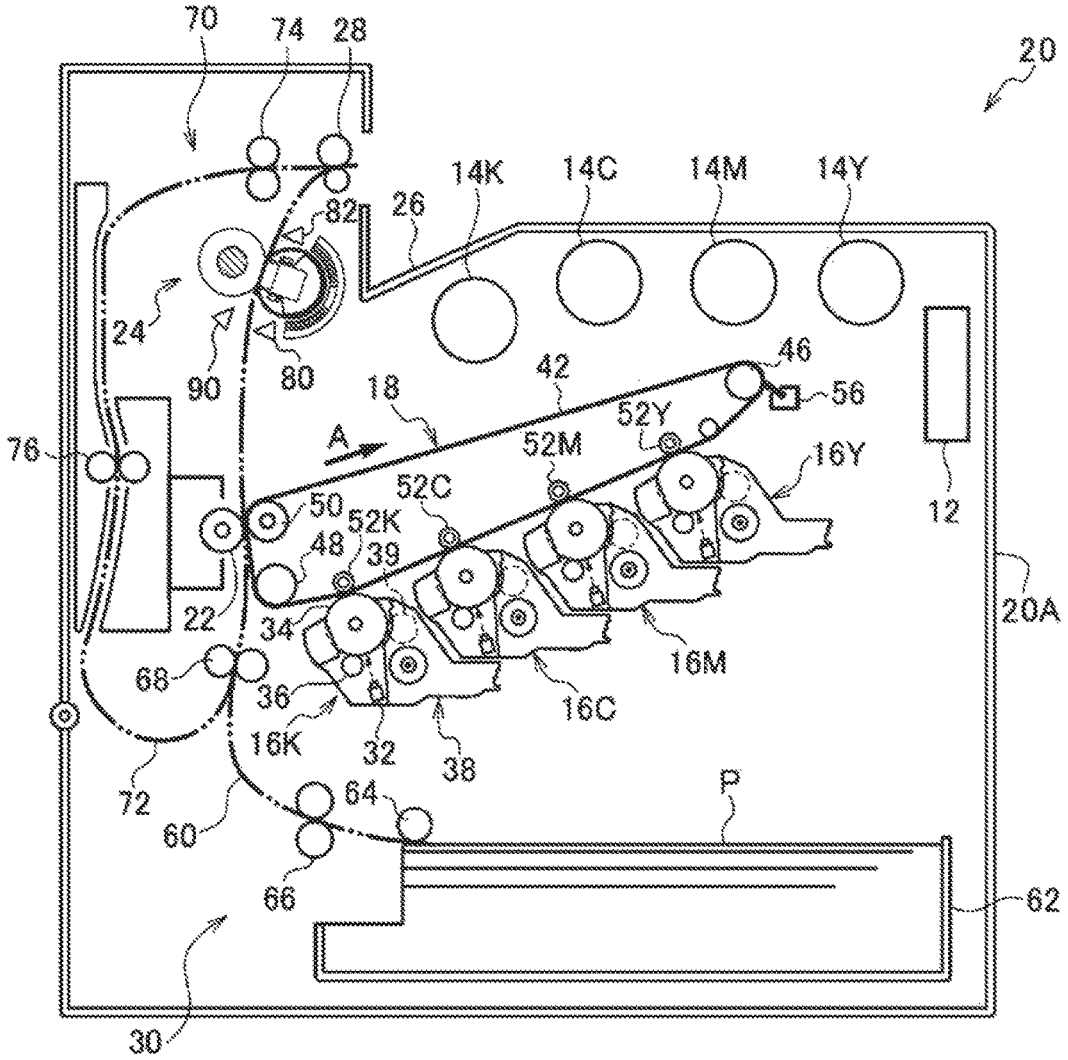
FIG. 11 is a schematic diagram illustrating a configuration of an image forming apparatus according to a second exemplary embodiment.
Figure 12:
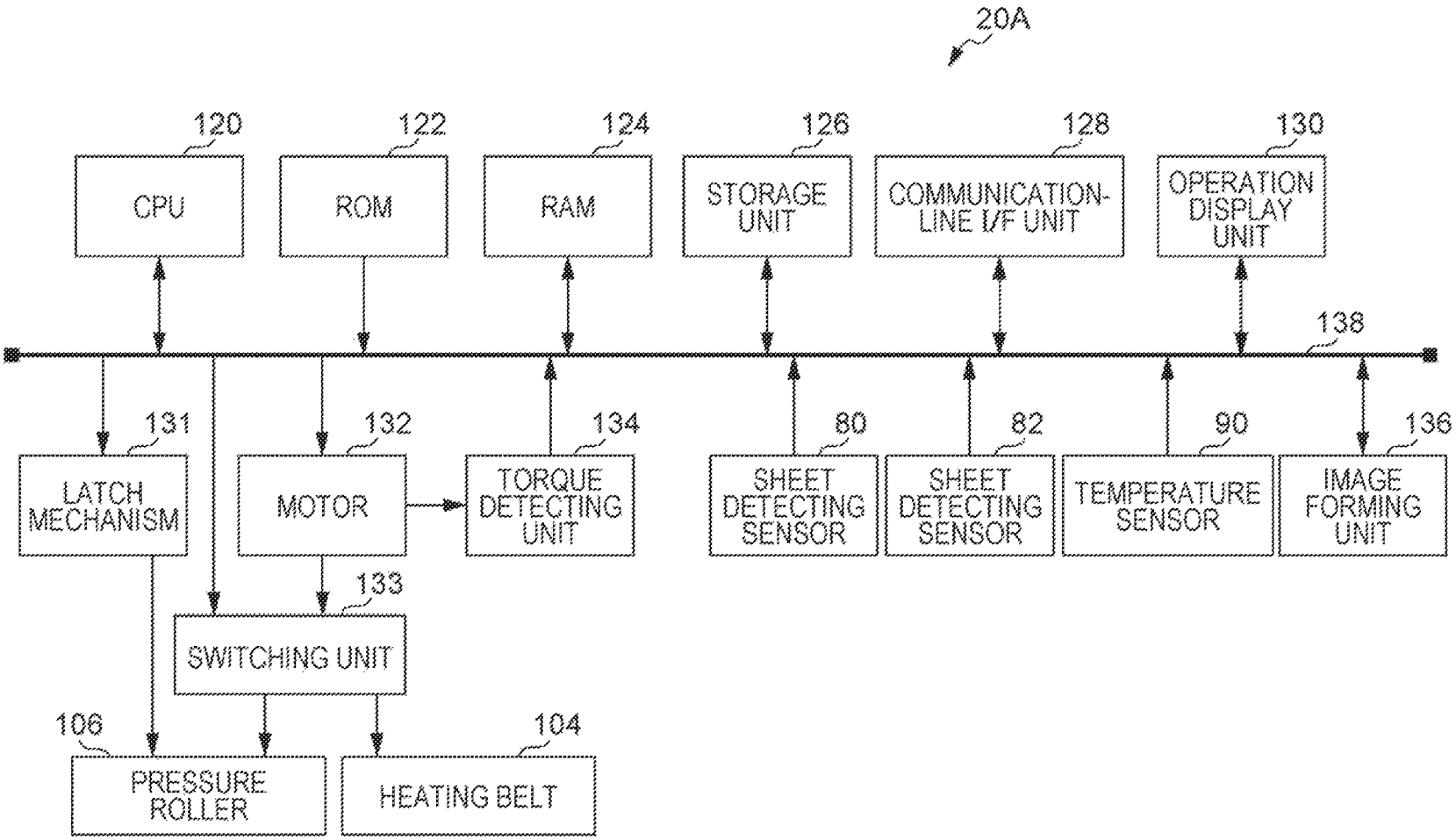
FIG. 12 is a block diagram illustrating relevant elements included in an electrical system of the image forming apparatus according to the second exemplary embodiment.

FIG. 11 is a diagram of an image forming apparatus 20 according to the second exemplary embodiment. FIG. 12 is a block diagram illustrating relevant elements included in the electrical system of the image forming apparatus 20. The image forming apparatus 20 differs from the image forming apparatus 10 illustrated in FIG. 1 in including a temperature sensor 90 as an exemplary temperature detector.

The temperature sensor 90 is provided near the fixing device 24 and detects the temperature of the fixing device 24.

Figure 13:
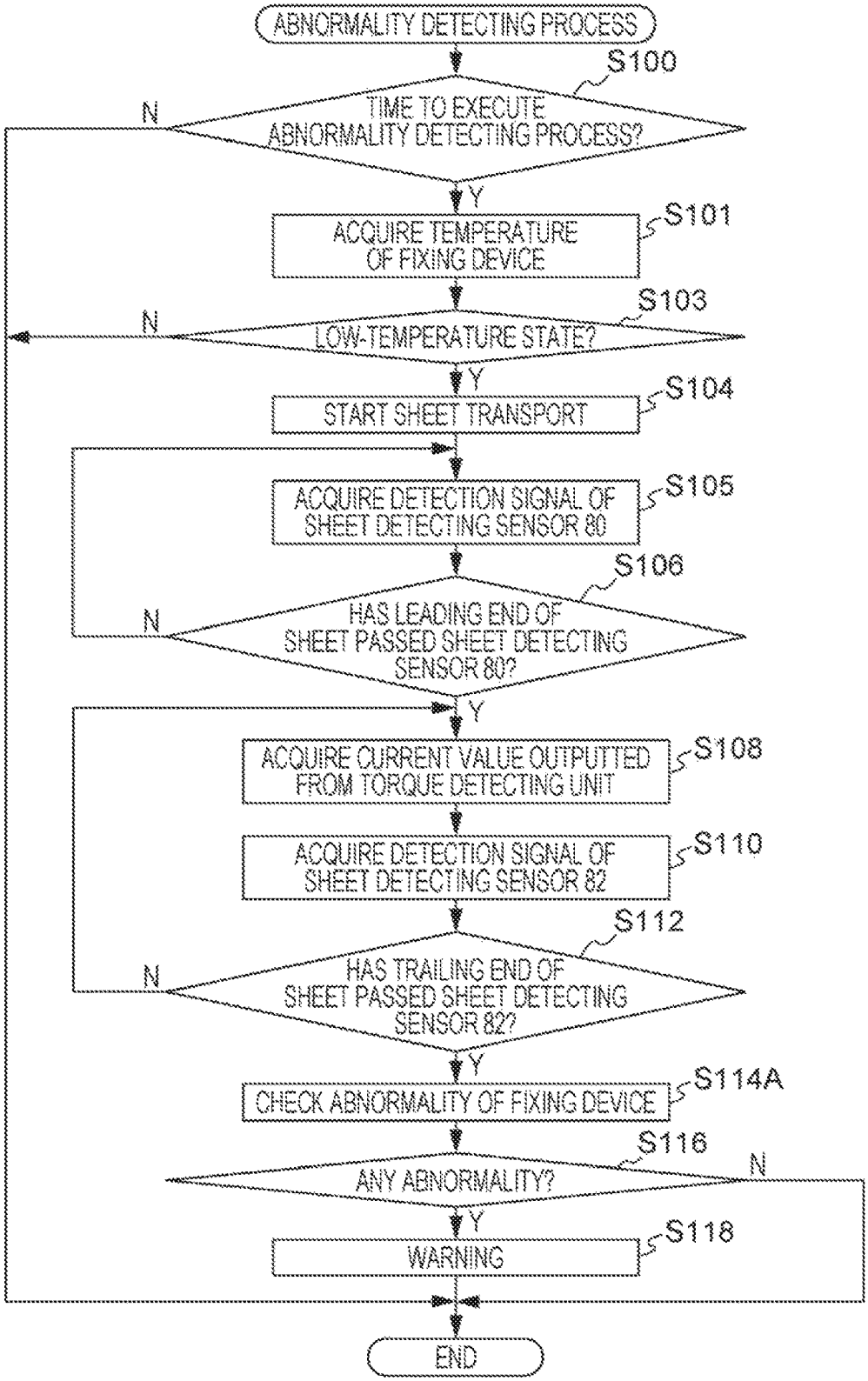
FIG. 13 is a flow chart illustrating a process of executing an abnormality detecting program according to the second exemplary embodiment.

Referring now to FIG. 13, an operation of the image forming apparatus 20 according to the second exemplary embodiment that is performed when an abnormality detecting function according to the second exemplary embodiment is executed will be described.

Steps that are the same as those included in the abnormality detecting process illustrated in FIG. 8 are denoted by corresponding ones of the reference numerals used in FIG. 8, and detailed description of such steps is omitted.

In step S101, the temperature of the fixing device 24 is acquired from the temperature sensor 90.

In step S103, whether or not the fixing device 24 is in the low-temperature state is checked on the basis of the temperature acquired in step S101. If the determination in step S103 is positive, the process proceeds to step S104. If the determination in step S103 is negative, the process ends.

In step S114A, the CPU 120 checks whether or not the fixing device 24 has any abnormality by checking whether or not the difference between the initial value and the detected current value is greater than or equal to a predetermined threshold. Specifically, the CPU 120 checks the occurrence of any abnormality in the fixing device 24 with reference to the relationship between the temperature acquired in step S101 and the change in the detected current value that occurs when the sheet P passes through the fixing device 24. As described above, the detected current value changes with the temperature of the fixing device 24. The higher the temperature of the fixing device 24, the lower the detected current value. Hence, if a constant threshold is set regardless of the temperature of the fixing device 24, the detection of whether or not the fixing device 24 has any abnormality may be done wrong. To avoid such a wrong detection, the initial value and the threshold are set in accordance with the temperature of the fixing device 24. For example, a data table or an expression representing the relationship among the temperature of the fixing device 24, the initial value, and the threshold is stored in advance in the storage unit 126, and the initial value and the threshold corresponding to the temperature of the fixing device 24 are set on the basis of the data table or the expression.

As described above, according to the second exemplary embodiment, whether or not the fixing device 24 has any abnormality is detected with reference to the temperature of the fixing device 24 that is detected by the temperature sensor 90.

While the above exemplary embodiments each concern a case where the sheets P are of one kind, the sheet feeding member 62 may contain sheets P having different thicknesses. In that case, whether or not the fixing device 24 has any abnormality may be detected by using one of the sheets P that has the largest thickness and passing that sheet P through the fixing device 24. That is, in step S104 illustrated in FIG. 8 or 13, the thickest one of the sheets P having different thicknesses is selectively transported. The thicker the sheet P, the greater the change in the detected current value and the easier the detection of the occurrence of abnormality.

The image forming apparatuses 10 and 20 described in the first and second exemplary embodiments each include the duplex transport device 70 as an exemplary transport device that transports the sheet P for the formation of an image on the back side of the sheet P, having an image on the front side thereof fixed by the fixing device 24, by the image forming unit 136.

For example, if the image forming apparatus 10 or 20 is powered first thing in the morning for the execution of an image forming process, it takes time for the temperature of the fixing device 24 to reach the fixing temperature. Hence, the image forming process on the sheet P is not started until the temperature of the fixing device 24 reaches the fixing temperature. Using such waiting time, a sheet P may be transported and the abnormality detecting process may be performed.

In that case, a sheet P is passed through the fixing device 24 before the temperature of the fixing device 24 reaches the fixing temperature for the fixation of the image, and the abnormality detecting process is executed. Subsequently, when the temperature of the fixing device 24 has reached the fixing temperature, the image forming unit 136 is controlled to cause the duplex transport device 70 to form an image on the sheet P.

That is, the abnormality detecting process may be executed by transporting a sheet P before the temperature of the fixing device 24 reaches the fixing temperature, i.e., in the low-temperature state. Subsequently, after the sheet P is turned over by using the duplex transport device 70 and when the temperature of the fixing device 24 has reached the fixing temperature, an image may be formed on the sheet P.

While the above exemplary embodiments each concern a case where the fixing device 24 employs an induction-heating (IH) method in which heat is generated by electromagnetic induction, the fixing device 24 is not limited to such a fixing device and may be of another type, such as a device employing a halogen lamp.

While the above exemplary embodiments each concern a case where a program for executing the abnormality detecting process is preinstalled in the ROM 122, the present invention is not limited to such a case. For example, a program for executing the abnormality detecting process may be provided as a program stored in a storage medium such as a compact-disk read-only memory (CD-ROM) or may be provided over a network.

While the above exemplary embodiments each concern a case where the abnormality detecting process is executed as a software program that is executable on a computer, the present invention is not limited to such a case. For example, the function of performing the abnormality detecting process may be provided in the form of hardware or a combination of hardware and software.

The configuration of each of the image forming apparatuses 10 and 20 described in the first and second exemplary embodiments (see FIGS. 1 to 4 and FIGS. 11 and 12) is only exemplary. Needless to say, any unnecessary part may be omitted or any additional part may be included without departing from the essence of the present invention.

The flow of the program for executing the abnormality detecting process described in each of the first and second exemplary embodiments (see FIGS. 8 and 13) is also exemplary. Needless to say, any unnecessary steps may be omitted, any additional step may be included, or the order of performing the steps may be changed without departing from the essence of the present invention.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a fixing unit including a pressing device and a heating device, the fixing unit configured to fix an image formed on a recording medium by nipping the recording medium with the pressing device and the heating device;

a driving device configured to drive the fixing unit;

a load detector configured to detect a load applied to the driving device;

an abnormality detector configured to abnormality in the fixing unit with reference to the load generated when the recording medium passes through the fixing unit; and a temperature detector configured to detect a temperature of the fixing unit, wherein if the temperature detected by the temperature detector is lower than a fixing temperature at which the image is fixed, the abnormality detector is configured to detect whether or not the fixing unit has any abnormality by allowing the recording medium to pass through the fixing unit.

2. The fixing device according to claim 1, wherein the abnormality detector detects whether or not the fixing unit has any abnormality with reference to a relationship between the temperature detected by the temperature detector and a change in the load generated when the recording medium passes through the fixing unit.

3. The fixing device according to claim 1, wherein if a period of time over which the temperature of the fixing unit becomes lower than a fixing temperature at which the image is fixed has elapsed since a last execution of the fixing by the fixing unit, the abnormality detector detects whether or not the fixing unit has any abnormality by allowing the recording medium to pass through the fixing unit.

4. The fixing device according to claim 1, wherein the load generated when the recording medium passes through the fixing unit and with reference to which the abnormality detector detects whether or not the fixing unit has any abnormality is a load generated during at least part of a passing period over which the recording medium passes through the fixing unit, the passing period being a period excluding an entering period over which the recording medium enters the fixing unit and an exiting period over which the recording medium exits the fixing unit.

5. The fixing unit according to claim 1, wherein the recording medium is one of a plurality of recording media having different thicknesses, and the abnormality detector detects whether or not the fixing unit has any abnormality by selectively allowing a thickest one of the plurality of recording media to pass through the fixing unit.

6. An image forming apparatus comprising:

an image forming device configured to form an image on a recording medium; and the fixing device according to claim 1 configured to fix the image on the recording medium.

7. The image forming apparatus according to claim 6, wherein the image forming device is configured to form no image on the recording medium when whether or not the fixing unit has any abnormality is detected with reference to the load generated when the recording medium passes through the fixing unit.

8. The image forming apparatus according to claim 6, further comprising:

a transport device configured to transport the recording medium after an image formed on one side of the recording medium is fixed by the fixing device, the transport device transporting the recording medium such that another image is formed on an other side of the recording medium by the image forming device; and a controller configured to control the transport device such that the abnormality detector detects whether or not the fixing unit has any abnormality by allowing the recording medium to pass through the fixing unit before the temperature of the fixing unit reaches the fixing temperature at which the images are each fixed, and such that the images are formed on the recording medium by the image forming device after the temperature of the fixing unit has reached the fixing temperature.

9. The image forming apparatus according to claim 7, further comprising:

a transport device configured to transport the recording medium after an image formed on one side of the recording medium is fixed by the fixing device, the transport device transporting the recording medium such that another image is formed on an other side of the recording medium by the image forming device; and a controller configured to control the transport device such that the abnormality detector detects whether or not the fixing unit has any abnormality by allowing the recording medium to pass through the fixing unit before the temperature of the fixing unit reaches the fixing temperature at which the images are each fixed, and such that the images are formed on the recording medium by the image forming device after the temperature of the fixing unit has reached the fixing temperature.

10. A fixing device comprising:

fixing means including pressing means and heating means, the fixing means configured to fix an image formed on a recording medium by nipping the recording medium with the pressing means and the heating means;

driving means for driving the fixing means;

load detecting means for detecting a load applied to the driving means;

abnormality detecting means for detecting abnormality in the fixing means with reference to the load generated when the recording medium passes through the fixing means; and a temperature detecting means configured to detect a temperature of the fixing means, wherein if the temperature detected by the temperature detecting means is lower than a fixing temperature at which the image is fixed, the abnormality detecting means is configured to detect whether or not the fixing has any abnormality by allowing the recording medium to pass through the fixing means.

* * * * *